United States Patent [19]

Liepert

[11] 4,302,001

[45] Nov. 24, 1981

[54] DEVICE FOR FORMING A SEQUENCE OF UNDERLAPPING SHEETS

[75] Inventor: Rudolf Liepert, Augsburg, Fed. Rep. of Germany

[73] Assignee: Georg Spiess GmbH, Gersthofen, Fed. Rep. of Germany

[21] Appl. No.: 103,697

[22] Filed: Dec. 14, 1979

[30] Foreign Application Priority Data

Jan. 23, 1979 [DE] Fed. Rep. of Germany ..... 2902447

[51] Int. Cl.[3] ..... B65H 29/66; B65H 29/68

[52] U.S. Cl. ..... 271/183; 83/88; 83/100; 271/202; 271/216

[58] Field of Search ..... 271/183, 182, 212, 216, 271/229, 230, 231, 202, 194, 203, 270; 83/88, 100; 198/462, 423

[56] References Cited

U.S. PATENT DOCUMENTS

| | | | |
|---|---|---|---|
| 3,232,605 | 2/1966 | Plummer et al. | 271/183 |
| 3,730,515 | 5/1973 | Spiess | 271/183 X |
| 4,136,865 | 1/1979 | Marasi | 271/183 |
| 4,221,377 | 9/1980 | Bodewein et al. | 271/183 |

FOREIGN PATENT DOCUMENTS

| | | | |
|---|---|---|---|
| 601816 | 8/1934 | Fed. Rep. of Germany | 271/183 |
| 2137335 | 1/1973 | Fed. Rep. of Germany | 271/183 |

*Primary Examiner*—Bruce H. Stoner, Jr.
*Attorney, Agent, or Firm*—Max Fogiel

[57] ABSTRACT

An arrangement for forming a sequence of underlapping sheets when conveying sheets that are cut off a paper web by a sheeter located in front thereof, to the feed table of a machine working the sheets. Suction equipment is located above the sheet web in the area between two draw-off equipments which are driven at different feed rates. A lifting device is located below the sheet web to bring the rear zone of every sheet into action with the suction equipment, so as to form a guide gap for the following sheet. The suction equipment is provided with a suction box connected to a vacuum supply that may be adjusted stationary during operation. The suction box has at the bottom a punched plate which is provided with a width corresponding to the maximum workable sheet width.

8 Claims, 3 Drawing Figures

1
2
3
4
5
6
7
8
9
10
11
12
13
14
15
16
17
18
19
20
21
22
23
24
25
26
27
28
29
30
31
32
33
34
35
36
37
38
A
B

DEVICE FOR FORMING A SEQUENCE OF UNDERLAPPING SHEETS

This invention relates to a device for forming a sequence of underlapping sheets when conveying sheets that are cut off a paper web by means of a sheeter arranged before, to the feed table of a machine working these sheets, with a suction equipment arranged above the sheet web in the area between two draw-off equipments that are driven with different feed rates, and with a lifting equipment arranged below the sheet web, that brings the rear zone of every sheet into action with the suction equipment in order to form a guide gap for the following sheet.

An arrangement of this kind is known from the DE-PS No. 21 37 335. With this known arrangement, suckers that are movable to and fro, are provided to form the suction equipment which is arranged above the sheet web. These suckers are in practice divided in two groups that are suspended pendulously and are connected to each other in such a way that one group is brought into the original position, while the other group is pulled in the direction of running by the sheet. This known arrangement has only shown satisfying results with low working speeds. As a result of the application of force, exerted here practically more or less pointlike, a comparatively high vacuum is required with this known arrangement in order to hold the lifted sheet securely. This has, however, a negative effect on the power input and, due to this, on the power consumption, seen in the long run. Apart from this, there is a secondary effect, that is felt to be most disadvantageous, that practically all suckers of a group of suckers will fail if only one of these suckers is not completely covered by the lifted sheet. This results in the necessity of adjusting the position of the suckers according to the size that is being worked; this not only leads to comparatively long setting times, but at the same time requires relatively high constructional expenditure. Apart from this, the arrangement as described above, proved to be too slow for increased working speeds.

An experiment in this course in order to remove this difficulty by using continuously driven, rotating grippers, which has turned out to be quite useful for some cases of application, is described in the DE-OS No. 26 38 783. The grippers used here can, however, produce substantial noise. Besides this, the attainable distance between the scales is given firmly by the individual distance between the grippers, a fact that will prove negatively if various distances between the scales are required. Moving parts, such as the rotating grippers used here, demand moreover appropriate accident preventing devices in the form of covers etc., a fact that may cause considerable expenditure. This disadvantage is also valid for the suckers moved to and fro of the above mentioned kind. A further difficulty when using moved parts such as suckers moved to and fro or rotating grippers, is the necessity to synchronize these parts with the drive of the draw-off equipments that are decisive for the size of the scales.

A further known proposition of the already mentioned DE-OS No. 26 38 783 is to suck the rear end of the sheet by means of a suction flap that is equipped with blow nozzles. With this, a uniform admission of air blast to all nozzles is to be expected, even if some nozzles are not covered. It is, however, a disadvantage that the air blast used here, which emerges at a comparatively high speed and which has to escape into the machinery space, can not only cause considerable annoyance by noise, but at the same time can also lead to considerable failures due to the raising of dust and admission of sheets that arrive anew.

Proceeding from here, it is therefore the problem of the present invention, while avoiding the disadvantages of the known devices, to create a device of the kind as mentioned at the beginning, that is constructed in a simple and easy-to-survey manner.

It is a further object of the present invention to provide a device that can be manufactured at low cost.

It is a still further object of the present invention to provide a device that is independent of the size being worked and therefore needs no lateral adjustment and, due to this, is easy to operate and proves to be easy for maintenance. It is intended that the device also has no moving parts, at least not above the sheet web, so that it may work almost without wear.

It is a still further object of the present invention to provide a device that needs no accident preventing devices.

It is also an object of the present invention to provide a device that has a comparatively low power input, and from which device a trouble-free operation may be expected.

The problem is solved, according to the invention, in a surprisingly simple way by the fact that the suction device has a suction box, which is connected to a vacuum supply, that is fixed stationary during operation, and that is bounded at the bottom by a punched plate, the width of which corresponds to the maximum workable sheet width at least.

These measures obviously result in a practically stationary arrangement that does not contain danger of injuries to the operator, due to which fact practically any expenditure for protective measures in the form of covers etc. can be left away. There is moreover practically no wear and tear with an arrangement of the kind presented here, that is practically stationary. Due to this, the arrangement according to the invention has a practically unlimited service life, and moreover proves to be practically maintenance-free. Nevertheless, a high reliability is guaranteed. With the stationary arrangement of the kind according to the invention, the difficulty, existing with the known arrangements, with regard to synchronizing the means that lift the rear end of the sheet with the devices for transport or for deceleration, that are decisive for the distance between the scales, does not exist. The sheet that is brought in contact with the punched plate simply glides over it in an advantageous manner, and at the same time there is a desirable tightening of the sheet. In doing so, it is at the same time guaranteed that the sheet lies with its entire width properly close to the punched plate, therefore pendent corners, that might prevent the subsequent sheet from slipping in, are not to be feared. The punched plate used here makes it feasible to take the sheet at many points practically at the entire surface, therefore a high holding power results from this even in case of a comparatively low vacuum, a fact that has an advantageous effect on the power input and therefore on the power consumption, too. It turned out in a surprising manner, that due to the comparatively great amount of holes that can be placed on the punched plate, the hole diameter being comparatively small, full performance is ensured even if only part of the holes existing are covered. The arrangement according to the invention therefore advantageously proves to be absolutely independent of the size that is being worked, as well as of the desired distance between the scales. A further advantage is that here practically no disturbing outgoing air is to be feared.

According to an especially advantageous further development of the generic measures, the holes of the punched plate may be distributed in such a way that the density of holes decreases in the direction of sheet transport. Due to this, it is advantageously attained that the sheet is released smoothly and practically without a sudden movement.

A further suitable development of the punched plate according to the invention can be done by inclining the connecting lines between one hole and at least the holes adjacent to this hole against the direction of sheet transport. This measure advantageously favours a contact of the sheet on its entire surface with the punched plate, while at the same time the forming of creases or traces are prevented, which would have to be feared if the holes were arranged in rows behind each other in the direction of sheet transport.

A further development of the generic measures that is most favourable and therefore is to be preferred, is characterized in that the suction box consists of two plates that are spaced, at least by means of a packing, all-around at the borders, the bottom plate of which is formed as a punched plate, and the top plate has a vacuum connecting socket. The measures mentioned in the foregoing obviously result in a most simple and therefore a low-cost design. A further measure, referring to a suitable construction of the suction box, can consist in providing an all-around bearing frame, on to which the spaced plates are fixed. These measures result in an especially high rigidity. At the same time a pan or similar is formed by the bearing frame, that is practically closed at the bottom by the plates, which is advantageously suited as a disposal area for tools etc.

It can prove especially advantageous in many cases if the suction box is supported angularly adjustable. Thereby the angular position can suitably be adjustable. On the other hand, these measures render it possible to incline the suction box and in doing so, the punched plate that comes into action with the sheet to be held, corresponding to the desired angle of inclination of the guide gap, which can be useful for a contact on the entire paper surface. On the other hand, there is also the possibility to bring the suction box out of the normal operating position by tilting it upwards, which can have most advantageous effects in the case of failures.

As a further development of the generic measures the suction box can at the same time be supported vertically adjustable. In doing so, it is possible to adapt the distance between the punched plate and the sheet web to the paper quality that is being worked.

Further advantages and features for a useful development of the generic measures will result from the description of an embodiment, as mentioned below, on the basis of the drawing in conjunction with the remaining dependent claims.

In doing so

Figures 1, 2:
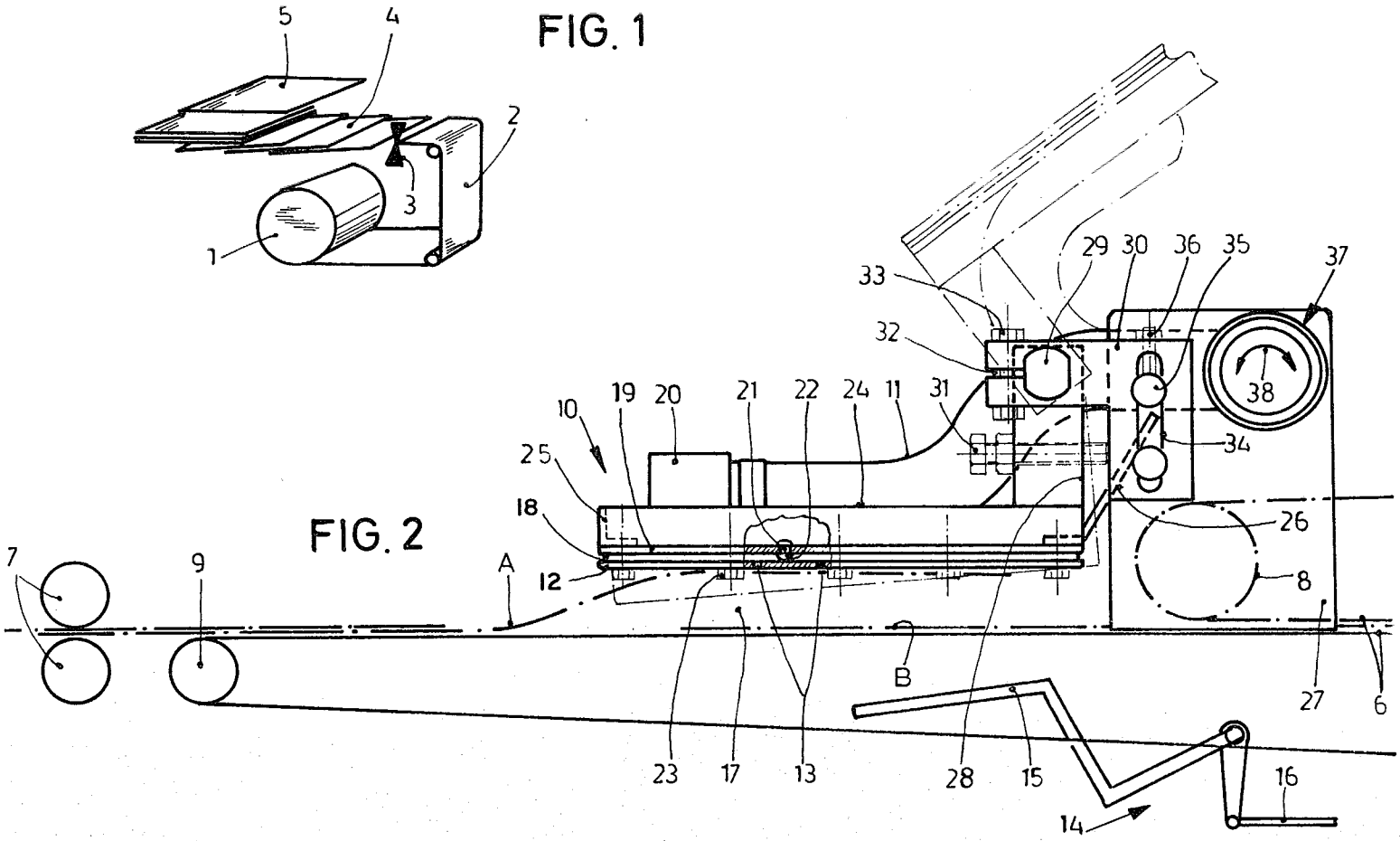
FIG. 1 shows the method of operation of a reel-sheet unit on principle.
FIG. 2 shows a view of an especially preferred embodiment of the invention, partly sectional view.

The processing of paper reels by means of sheet-fed presses has a great amount of advantages, since especially a considerable increase of output and a decrease of costs are attained. In doing so, a paper web 2 is drawn off a paper reel 1, as indicated under FIG. 1; subsequently sheets are cut off the paper web by means of a sheeter, as indicated under 3. Subsequently the cut-off sheets are brought together by means of a device which will be explained more detailed below, to form a sequence of underlapping sheets as indicated under 4, which runs into a sheet feeding apparatus, not shown in detail, as indicated under 5; the sheet feeding apparatus feeds the sheets in cycles to a sheet working machine, as e.g. a printing machine.

In order to form the sequence of sheets as indicated under 4, two draw-off equipments 6 and 7 are arranged subsequently to the sheeter 3, as indicated under FIG. 2, the rear draw-off equipment 6 which is near the sheeter, runs with increased speed as compared to that of the paper web, and the draw-off equipment 7 at the front runs at reduced speed, thereby forming a scale-like paper web. In the represented embodiment the rear draw-off equipment is designed as tape guide with deflection pulleys 8 and 9. The front draw-off equipment 7 is designed as a pair of rollers. In the range between the deflection pulley 8 of the shorter, top tape guide of the draw-off equipment 6 and the front draw-off equipment 7 there is, above the sheet web here being supported only by the bottom tape guide of the rear draw-off equipment 6, a suction box provided, the complete unit being specified under 10, which is connected to a vacuum supply. To do so, a connecting hose 11 is provided. The suction box 10 is bounded at the bottom by a punched plate, indicated under 12, which has a great amount of small holes 13, distributed on the entire area of the punched plate 12. As soon as there is a vacuum in the suction box 10, suction is exerted via the holes 13, which is sufficient to bring a sheet, that is near the punched plate 12, in contact with the punched plate 12. In doing so, a guide gap is formed into which each following sheet can slip in order to form a scale-like sheet web. Below the sheet web, defined by the bottom, longer tape guide of the rear draw-off equipment 6, there is a lifting device, the whole of which is represented with 14. The lifting device 14 may be designed as single blow nozzle. In the represented embodiment there is, in order to form the lifting device 14, a flap 15, supported angularly adjustable, provided, which can be operated in cycles by means of a push rod 16 in such a way as to bring the rear end of the sheet which is above in contact with the punched plate 12, as soon as the front end of this sheet is taken by the front draw-off equipment 7. FIG. 2 is based on a situation where the rear end of the front sheet A is already in action with the punched plate 12, and the following sheet B slips into the guide gap, indicated under 17. The lifting device 14 is in a delay position. The flap 15 is expediently provided with several teeth, arranged in the form of a rake between the single tapes of the bottom tape guide of the rear draw-off equipment 6. The same applies if the lifting device is operated pneumatically.

During operation, there is a permanent vacuum in the suction box 10. Therefore the surface of the rear end of the sheet, the kind of which is indicated under A, that is brought into action with the suction box, is in contact with the punched plate 12. The retaining force exerted on this sheet via the holes 13, results at the same time in a tightening of the sheet that is conveyed further by the front draw-off equipment 7, in the course of which the rear end of the sheet slides smoothly over the punched plate 12. The punched plate 12 may be expediently polished on the range of its bottom surface in order to increase the slidability. The distribution of the holes 13 over the entire surface of the punched plate 12 not only results in an even contact of the sheet on its entire surface, but also results in a sufficient retaining force while the vacuum may be low in proportion, due to the large effective surface. The cross section of the individual holes 13 may nevertheless be comparatively small. A diameter of the holes of approximately 1.5 mm has especially held good when tests were carried out. Since already a low vacuum is sufficient to retain the sheet positively, as explained above, a sufficient retaining force is favourably guaranteed even if not all holes 13 of the punched plate 12 are covered. The length and width of the suction box 10 or of the punched plate 12 are therefore absolutely independent of the size being worked. The punched plate 12 therefore runs over the full width of the machine; due to this, lateral adjustment can be omitted. The length of the punched plate 12 corresponds to the maximum desired distance between the scales. The distance between the scales is, however, given firmly as a rule. In those cases the length of the punched plate 12 will be adapted to it.

The suction box 10 consists in the represented embodiment of two even plates, which are spaced by means of a packing 18, inserted at the borders, expediently a packing cord. The bottom plate is the punched plate 12, already mentioned above. The top plate 19 is provided with a connecting socket 20 for the hose 11 that is leading to a vacuum supply. The inherent stability of the plates 12 and 19 normally is sufficient to resist the low vacuum existing in the chamber bounded by these two plates. If necessary, the plates 12 and 19 can be spaced from each other within the cavity of the chamber bounded by the packing 18. In order to do so, rivets 21 are provided that are inserted into the top plate 19, as indicated under FIG. 2, the heads 22 of which are extended into the cavity of the chamber, and due to that can accomplish the required spacing. In the represented embodiment the plates 12 and 19, that are spaced by means of the all-around packing 18, are screwed onto a suspension frame 24 by means of screws 23, arranged at the border. The suspension frame 24 may, as indicated under 25, be formed in a simple way by bars that are welded together. In doing so, a pan-shaped structure is obtained, open at the top, which is suited for a favoured place of disposal. The free leg 26 of the rear frame bar is set inclined to the rear and is expediently designed thus long that the deflection pulleys 8 of the top tape guide of the rear draw-off equipment 6 are properly covered by it.

The suction box 10 may be fixed to the frame by means of lateral bearing fish plates 27. In the represented embodiment the suction box 10 is supported angularly and vertically adjustable at the bearing fish plates 27, arranged behind it. In order to do so, the suction box 10 is provided with swinging arms 28 attached in the area of the rear corners, which are suspended angularly adjustable at one pillow block 30 each. In order to adjust the angular position and thereby the inclination of the cored panel, formed by the punched plate 12, forming the top termination of the guide gap 17, adjusting screws 31, that are passed through the swinging arms 28, are provided, which are supported at one adjacent bearing fish plate 27 each. The reception of the bolts 29 is designed as clamping bearing, as indicated by the slot 32 and the assigned clamping screw 33. By means of this, the angular position, adjusted by means of the adjusting screws 31, can be set firmly. In case of failures, the suction box 10 may be swivelled favourably to the very top, as indicated under FIG. 2 by the dash-dotted lines. Due to this, there is an excellent accessibility to the sheet web. The pillow blocks 30, in their turn, are supported vertically adjustable at the bearing fish plates via a bolt 35, which engages into an oblong hole 34. An adjusting screw 36 is provided, assigned to each, in order to carry out adjustments. Due to this it is possible to bring the punched plate 12 near the bottom tape guide of the rear draw-off equipment 6, in case thick paper is being worked, or to lift it to a little distance from it if thinner paper is being worked. During operation, the suction box 10 remains, however, in stationary arrangement, so to speak.

A regulator valve 37 is provided expediently to adjust the intensity of the vacuum. In the represented embodiment the regulator valve 37 is simply inserted into an assigned socket of a lateral bearing fish plate 27 in such a way that the pointer knob is accessible from the side of the machine. The connecting socket of the regulator valve 37, that is not perceptible in the view as per FIG. 2, and which goes to the inside, can be connected favourably aligned to a pipe running to the opposite bearing fish plate 27, and which has approximately in its middle range a connection piece for the flexible hose 11.

Figure 3:
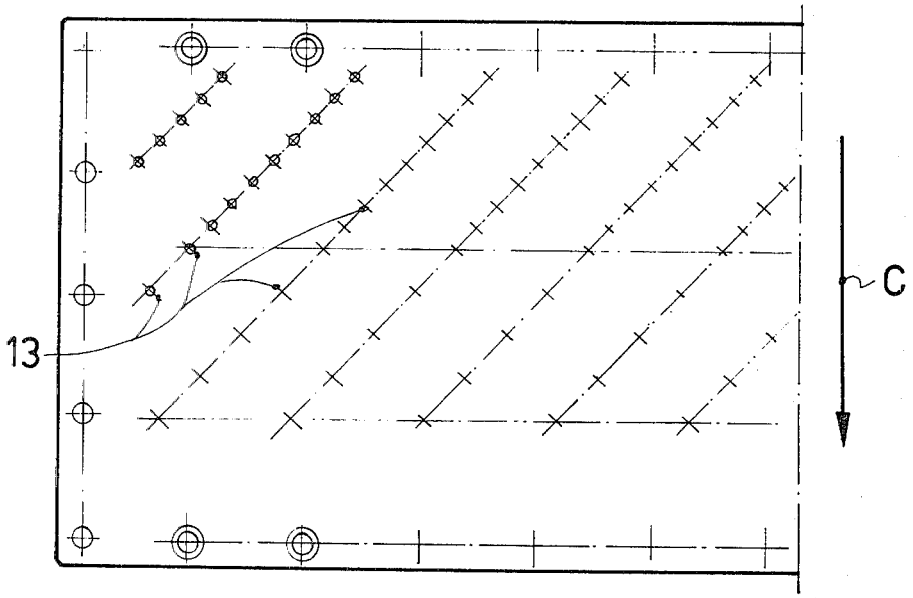
FIG. 3 shows a view of the punched plate, seen from below.

The holes 13 of the punched plate 12 are, as may be seen best in FIG. 3, arranged expediently on imagined lines inclined against the direction of sheet transport as marked by the arrow C, here inclined at an angle of 45 degrees. The density of holes, i.e. the number of holes per unit of area, may be uniform over the entire surface of the punched plate 12. In the represented embodiment we have provided in the area of the front half of the punched plate 12 a lesser density of holes than in the area of the rear half. Due to this, the retaining force decreases in the direction of feed, therefore the sheet is released comparatively smoothly. It would be conceivable to decrease the density of the holes continuously from rear to front. In the represented embodiment we have provided double distance between the holes in the area of the front half of the plate as compared to the rear half of the plate. The area adjacent to the front border may have even less holes. In the represented embodiment this area has no holes at all. The distance between the imagined lines, each interspersed by a line of holes, has expediently been chosen in such a way that no or very little connection lines run from one hole to the other holes in the direction of transport of the sheets, indicated by the arrow C. Such a distribution of the holes 13 favours a contact on the entire surface of the sheets most remarkably. Due to this, it is moreover guaranteed that no folds and creases etc. will occur.

In the represented embodiment the holes 13 are executed as round holes, the diameter of which, as mentioned above, may be approximately 1.5 mm. The holes 13 may be chamfered downwards. These holes 13 may simply be executed as bores, but also as punches, or they may be made by means of beam cutting.

I claim:

1. Device for forming a sequence of underlapping sheets when conveying sheets that are cut off a paper web by a sheeter arranged before, to the feed table of a machine working these sheets, comprising: suction means arranged above the sheet web in the area between two draw-off equipments that are driven with different feed rates, lifting means arranged below the sheet web and bringing the rear zone of every sheet into action with said suction means to form a guide gap for the following sheet, said suction means having a suction box connected to a vacuum supply means and adjusted stationary during operation, said suction box being bounded at the bottom by a punched plate having a width corresponding at least to the maximum workable sheet width, a supporting frame attached to said suction box above said web, said supporting frame being mounted pivotably and adjustable in height, said suction box having said punched plate and an auxiliary plate spaced from said punched plate, said punched plate being a lower plate and said auxiliary plate being an upper plate, said punched plate having a hole density which decreases in direction of transport of the sheets, said upper auxiliary plate having vacuum connection means and a circumferential packing at the rim of said auxiliary plate, said lower plate being spaced from said auxiliary plate by the region enclosed by said packing.

2. Device according to claim 1, wherein at least the bottom surface of the punched plate is polished.

3. Device according to claim 1, wherein the holes in said punched plate are arranged along lines which are inclined diagonally to the direction of transport of the sheets.

4. Device according to claim 3, wherein the holes of the punched plate in the front half of the plate are spaced from each other at twice the distance as compared to those in the rear half of the plate.

5. Device as defined in claim 1, wherein said punched plate has a length corresponding substantially to the maximum length of underlapping.

6. Device as defined in claim 1, including rivets in said auxiliary plate and having heads for spacing said punched plate and said auxiliary plate within the region bounded by said packing.

7. Device as defined in claim 1, wherein said suction box has an adjustable angular position.

8. Device as defined in claim 1, including regulator valve means connected to said vacuum supply means for adjusting the intensity of the vacuum.

* * * * *